US006335313B1

(12) United States Patent
Kasai et al.

(10) Patent No.: US 6,335,313 B1
(45) **Date of Patent: *Jan. 1, 2002**

(54) DETERGENT GRAINS AND GRANULAR DETERGENT COMPOSITION

(75) Inventors: Katsuhiko Kasai; Shu Yamaguchi; Hitoshi Takaya; Taiji Nakamae; Itsuro Tsukahara, all of Wakayama (JP)

(73) Assignee: Kao Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/066,451

(22) PCT Filed: Oct. 31, 1996

(86) PCT No.: PCT/JP96/03209

§ 371 Date: Apr. 28, 1998

§ 102(e) Date: Apr. 28, 1998

(87) PCT Pub. No.: WO97/16525

PCT Pub. Date: May 9, 1997

(30) Foreign Application Priority Data

Nov. 2, 1995 (JP) ..... 7-310138

(51) Int. Cl.[7] ..... C11D 1/722; C11D 3/08

(52) U.S. Cl. ..... 510/349; 510/356; 510/438; 510/441; 510/442; 510/444; 510/511

(58) Field of Search ..... 510/511, 349, 510/356, 441, 442, 438, 444

(56) References Cited

U.S. PATENT DOCUMENTS

| | | | | |
|---|---|---|---|---|
| 4,399,048 A | | 8/1983 | Gangwisch et al. | 510/323 |
| 4,664,839 A | * | 5/1987 | Rieck | 252/175 |
| 4,820,439 A | * | 4/1989 | Rieck | 510/469 |
| 5,078,895 A | * | 1/1992 | Dany et al. | 510/313 |
| 5,378,388 A | * | 1/1995 | Pancheri | 252/174.25 |
| 5,482,642 A | | 1/1996 | Agar et al. | 252/90 |
| 5,654,265 A | * | 8/1997 | Kuroda et al. | 510/507 |
| 5,736,501 A | * | 4/1998 | Yamashita et al. | 510/444 |

FOREIGN PATENT DOCUMENTS

| | | |
|---|---|---|
| GB | 1460646 A | 1/1977 |
| GB | 1471821 A | 4/1977 |

OTHER PUBLICATIONS

"Chemical Engineers' Handbook", John H. Perry, Ph.D., Editor, pp. 1130–1147, 1950.*

English abstract of JP–A–7–197084, Aug. 1, 1995.

English abstract of JP–A–7–197081, Aug. 1, 1995.

English abstract of JP–A–61–271399, Dec. 1, 1986.

English abstract of JP–A–51–506, Jan. 6, 1976.

English abstract of JP–A–62–278116, Dec. 3, 1987.

English abstract of JP–A–6–501973, Mar. 3, 1994.

* cited by examiner

*Primary Examiner*—Yogendra N. Gupta
*Assistant Examiner*—Brian P. Mruk
(74) *Attorney, Agent, or Firm*—Birch, Stewart, Kolasch & Birch, LLP

(57) ABSTRACT

In the detergent granules including 10% by weight or more of a nonionic surfactant and 1% by weight or more of a crystalline alkali metal silicate having an average particle size of from 1 to 60 $\mu$m, the detergent granules characterized in that a proportion of the nonionic surfactant to the crystalline alkali metal silicate is in a weight ratio of from 20/1 to 1/20, and that the iron content calculated as Fe in the crystalline alkali metal silicate is 140 ppm or less. The granular detergent composition characterized in that the granular detergent composition includes the detergent granules described above.

10 Claims, No Drawings

DETERGENT GRAINS AND GRANULAR DETERGENT COMPOSITION

This application is the national phase under 35 U.S.C. §371 of prior PCT International Application No. PCT/JP 96/03209 which has an International filing date of Oct. 31, 1996 which designated the United States of America, the entire contents of which are hereby incorporated by reference.

TECHNICAL FIELD

The present invention relates to detergent granules having an excellent degree of whiteness and a granular detergent composition. More particularly, the present invention relates to detergent granules containing a nonionic surfactant and a crystalline alkali metal silicate and having an excellent degree of whiteness, and a granular detergent composition containing the above detergent granules.

BACKGROUND ART

In detergents, for the purpose of improving their washing performance, builders for capturing water hardness-increasing components (for instance, $Ca^{2+}$, $Mg^{2+}$, and the like) which are present in tap water and builders for maintaining the alkalinity of the washing liquid are formulated aside from the surfactants. Ever since the eutrophication of rivers, lakes and marshes has become a social problem, zeolites have more frequently been used to act as the builders for capturing water hardness-increasing components in place of phosphorus compounds (tripolyphosphates and the like). Also, as for the alkali builders, carbonates and amorphous silicates have been usually used.

In recent years, crystalline alkali metal silicates which have a water hardness component-capturing function as well as an alkalizing-buffering function, which shows buffering ability as well as alkalizing ability, have been known to be used as detergent builders (Japanese Patent Examined Publication No. Hei 1-41116). Moreover, the crystalline alkali metal silicates not only are known as multi-functional builders, possessing both the alkalizing ability and the cationic exchange capacity, but also have a property wherein the crystalline alkali metal silicates are gradually dissolved after being released in the natural environment. Having the properties mentioned above, the crystalline alkali metal silicates have been markedly noted as excellent builders with a relatively small load to the environment. In particular, it has been known that in the case where these crystalline alkali metal silicates are used in combination with the nonionic surfactant, the resulting composition has excellent detergency against fatty acid stains (Japanese Patent Laid-Open Nos. Hei 6-10000 and Hei 6-116600).

Although the crystalline alkali metal silicates described above are water-soluble, they are only partially dissolved in a short time period such as the length of the washing time, so that there arise such problems that the crystalline alkali metal silicates adhere and remain on clothes as granules. In order to eliminate this problem, it is preferred to formulate crystalline alkali metal silicates which are powdered to have an average particle size of several dozens $\mu$m or less.

In addition, it has been unavoidable that the resulting detergent granules have a grayish color in cases where the crystalline alkali metal silicates and the nonionic surfactant are formulated in one granule, even though the crystalline alkali metal silicate powder obtained by powdering has a whitish color. This tendency is more remarkably noted in an industrial scale powdering, such as pulverization and milling, wherein a large amount of powdering treatment is required in a short period of time. Conventionally, it has also been known to blend a nonionic surfactant with a zeolite, an oil-absorbing carrier, or a carbonate in one granule (Japanese Patent Laid-Open Nos. Hei 4-339898 and Hei 5-5100). The detergent granules of such blends have excellent whitish color, and the "graying phenomenon" described above is a unique phenomenon occurring only in the cases where the crystalline alkali metal silicates and the nonionic surfactant are used in combination in one granule.

In general, it is needless of say that the whitish color powders are preferred as detergents. Since the detergents obtained by blending the crystalline alkali metal silicates and the nonionic surfactant in one granule have hues of grayish color, the commercial values of the detergents are drastically lowered regardless of having high detergency performance in the detergents.

Accordingly, objects of the present invention are to provide detergent granules which have remarkable improvements in hue and also have an excellent degree of whiteness and thus have high commercial values, and a granular detergent composition containing the above detergent granules.

These and other objects of the present invention will be apparent from the following description.

DISCLOSURE OF THE INVENTION

As a result intensive of research, the present inventors have found that in the detergent granules comprising the crystalline alkali metal silicates and the nonionic surfactants, the unique graying phenomenon mentioned above is ascribed to the fact that the difference in the refractive indices between the crystalline alkali metal silicates and the nonionic surfactants is small, and particularly that the graying phenomenon is greatly affected by the iron content mingled in the processes up to the preparation of the crystalline alkali metal silicate powders.

The present inventors have found that owing to the small difference in the refractive indices between the crystalline alkali metal silicates and the nonionic surfactants, an irregular reflection at the interface is substantially suppressed by the fact that the crystalline alkali metal silicates are coated by the nonionic surfactants, so that the resulting detergent granules have excellent transparency. In addition, the crystalline alkali metal silicates are usually obtained as baked products of block forms or masses of sizes of about several cm or more. In order to use the baked products as starting materials for detergent granules, a process of finely graining the baked products, which may be carried out previously or during the processes of producing the detergent granules, is unavoidable as mentioned above. By the additional finely graining process, the iron components are mingled during the finely graining process (powdering process) of the crystalline alkali metal silicate in addition to the iron components mixed in the starting materials for baking (water glass starting materials and alkali source, such as NaOH). Small amounts of the iron components mentioned above mingled therein give causation for greatly affecting the hue of the detergent granules. Although there is a possibility of the coloration under the same principle as conventionally used builders (such as zeolites and carbonates), since the crystalline alkali metal silicate is in the form of quite a rigid solid as compared to the conventional builders, the iron components are liable to be mingled in the finely graining process. In addition, the difference in the refractive indices with the nonionic surfactant becomes small, thereby resulting in the unique graying phenomenon in the cases where the crystalline alkali metal silicate and the nonionic surfactant are blended in one granule.

Moreover, the present inventors have found that the mingling of the iron components in the production process of the detergent granules can be remarkably inhibited by selecting starting materials with as little Fe content as possible and by using crystalline alkali metal silicate with a contrivance in the powdering method, so that the desired object mentioned above of the present invention can be achieved. The present invention has been completed based upon these findings.

Specifically, the present invention is in essence concerned with the following:

(1) In the detergent granules comprising 10% by weight or more of a nonionic surfactant and 1% by weight or more of a crystalline alkali metal silicate having an average particle size of from 1 to 60 $\mu$m, the detergent granules characterized in that a proportion of the nonionic surfactant to the crystalline alkali metal silicate is in a weight ratio of from 20/1 to 1/20, and that the iron content calculated as Fe in the crystalline alkali metal silicate is 140 ppm or less;

(2) The detergent granules described in item (1) above, characterized in that the nonionic surfactant is a polyoxyethylene alkyl ether;

(3) The detergent granules described in item (1) or item (2) above, characterized in that the crystalline alkali metal silicate has an $SiO_2/M_2O$ ratio of from 0.9 to 2.6, wherein M stands for an alkali metal;

(4) The detergent granules described in any one of items (1) to (3) above, wherein the crystalline alkali metal silicate is represented by the following formula (I):

$$xM_2O \cdot ySiO_2 \cdot zMe_mO_n \cdot wH_2O, \quad (I)$$

wherein M stands for an element in Group Ia of the Periodic Table; Me stands for one or more members selected from the group consisting of elements in Groups IIa, IIb, IIIa, IVa, and VIII of the Periodic Table; y/x is from 0.9 to 2.6; z/x is from 0.01 to 1.0; n/m is from 0.5 to 2.0; and w is from 0 to 20;

(5) The detergent granules described in any one of items (1) to (3) above, wherein the crystalline alkali metal silicate is represented by the following formula (II):

$$M_2O \cdot x'SiO_2y'H_2O, \quad (II)$$

wherein M stands for an alkali metal; x' is from 1.5 to 2.6; and y' is from 0 to 20;

(6) The detergent granules described in any one of items (1) to (5) above, characterized in that surfaces of granules comprising the crystalline alkali metal silicate are coated with a continuous phase of the nonionic surfactant;

(7) The detergent granules described in any one of items (1) to (6) above, characterized in that an L value is 90% or more; and (8) A granular detergent composition characterized in that the granular detergent composition comprises the detergent granules described in any one of items (1) to (7) above.

BEST MODE FOR CARRYING OUT THE INVENTION

In the detergent granule system of the present invention, comprising a nonionic surfactant and a crystalline alkali metal silicate used in combination, the detergent granules are characterized in that the iron content calculated as Fe in the crystalline alkali metal silicate is 140 ppm or less. In the present invention, the iron content in the crystalline alkali metal silicate, calculated as Fe, is preferably 120 ppm or less, more preferably 100 ppm or less.

As described above, by lowering the iron content calculated as Fe in the crystalline alkali metal silicate to 140 ppm or less, the detergent granules having an excellent degree of whiteness can be obtained.

Here, the iron content is measured by the steps of completely ashing a 0.5 g detergent sample, dissolving the obtained ash in 2 ml of 6N-HCl, diluting the obtained solution, and then analyzing by ICP (plasma emission spectrochemical analysis). In addition, an L value measured by a color-and-color difference meter "Model 1001DP" (manufactured by Nippon Denshoku Kogyo Kabushiki Kaisha) is used as index for the degree of whiteness. In the present invention, an L value is preferably 90% or more.

In order to have an iron content calculated as Fe of 140 ppm or less, it is particularly necessary to prevent the iron from being mingled in the crystalline alkali metal silicate in the step of formation of fine granules (powdering) of the crystalline alkali metal silicate aside from selecting starting materials with low Fe contents mixed therein. For instance, such methods include a method using a device for carrying out in principle the powdering of the masses by a mutual contact of the masses; and a method of changing the materials for parts contacting the masses subjected to powdering in a powdering device.

More specifically, as for the method using a device for carrying out in principle the powdering of the masses by a mutual contact of masses by using powdered forms obtained mainly by a mutual contact of masses by using, for instance, a vertical roller mill, as a powdering device, it is made possible to lower the iron content because the masses and iron are less likely to be contacting each other as in the case of, for instance, a hammer mill. Examples of the devices for powdering to such forms include vertical roller mills, roller mills, counter jet mills, and the like (in which a mutual collisions of the masses take place).

In addition, as for the methods for changing the materials for parts subjected to powdering, such materials as cemented carbide and ceramics may be used in place of the iron-containing parts in devices for powdering masses by a contact between the masses and iron itself, as in the case of a hammer mill. In addition, the surfaces of the parts contacting the masses subjected to powdering may be coated with the above materials by spraying methods and lining methods.

In addition to the hammer mills mentioned above, examples of the industrially usable powdering devices which have excellent powdering ability include jet mills wherein the masses are collided against the collision plate.

Besides the above, from the aspect of preventing the inclusion of Fe in the crystalline alkali metal silicate, such methods as lowering of the rotational speed of the hammer in the hammer mills, lowering of the frequency of the vibrating mills, or lowering of the rotational speed of the ball mills may be considered to thereby adjust to milder powdering conditions. However, the treatment speed becomes too slow to a level practically undesirable for industrial scale.

Further, it would be necessary to prevent the mingling of iron components during transportation in the production facilities. For instance, in a conventionally employed pneumatic transportation, the iron components are liable to be mingled by the collision with the detergent granules at the inner walls of the iron pipe, particularly an arm portion (curved pipe portion). In order to prevent this, the inner walls of the iron pipe may be coated with alumina ceramics, etc, or rubber lining or pipes made of resins may be used.

Incidentally, the lowering of the iron content therein would at the same time lead to the lowering of the contents of such metals as nickel and chromium in the parts contacting the masses subjected to powdering in the powdering device, which in turn results in an improvement of the hue of the resulting detergent granules.

The detergent granules of the present invention containing a nonionic surfactant in an amount of 10% by weight or more, particularly 15% by weight or more, and more specifically 20% by weight or more, and a crystalline alkali metal silicate in an amount of 1% by weight or more, particularly 3% by weight or more, and more specifically 5% by weight or more, and the detergents granules having proportional amounts of both components, i.e. the nonionic surfactant/the crystalline alkali metal silicate, of from 20/1 to 1/20, particularly 20/1 to 1/5, most specifically 20/1 to 1/3 are effectively used. The production methods therefor, ingredients other than the iron components, the compositions, etc. are equivalent to conventionally known detergent granules without being particularly limited, except that the content of the iron component is within the range mentioned above.

The nonionic surfactants may be exemplified as follows.

Specifically, examples thereof include polyoxyethylene alkyl ethers, polyoxyethylene alkylphenyl ethers, polyoxyethylene sorbitan fatty acid esters, polyoxyethylene sorbitol fatty acid esters, polyethylene glycol fatty acid esters, polyoxyethylene glycol fatty acid alkyl esters, polyoxyethylene polyoxypropylene alkyl ethers, polyoxyethylene castor oils, polyoxyethylene alkylamines, glycerol fatty acid esters, higher fatty acid alkanolamides, alkyl glucosides, alkyl glucosamides, and alkylamine oxides.

Among these nonionic surfactants, from the aspect of giving high washing performance, it is preferred to use the polyoxyethylene alkyl ethers, and it is more preferred to use the polyoxyethylene alkyl ethers which are ethylene oxide adducts of alcohols each having an average number of carbon atoms of from 10 to 18, wherein the ethylene oxide adduct has an average molar amount of 5 to 15. It is still more preferred to use polyoxyethylene alkyl ethers which are ethylene oxide adducts of alcohols each having an average number of carbon atoms of from 12 to 14, wherein the ethylene oxide adduct has an average molar amount of 6 to 10.

Crystalline Alkali Metal Silicates

The crystalline alkali metal silicates usable in the present invention are provided with not only good alkalizing ability but also good ion exchange capacity, thereby making it possible to further reduce the standard amount of dosage of the resulting detergent compositions.

In addition, the resulting powdered crystalline alkali metal silicate used in the present invention preferably has an average particle size of from 1 to 60 $\mu$m, and more preferably has an average particle size of from 1 to 30 $\mu$m. When the average particle size exceeds 60 $\mu$m, the ion exchange speed is likely to be slowed, thereby lowering the detergency, which in turn causes the adhesion of the crystalline alkali metal silicates to clothes after washing, which remain thereon after washing.

Here, the average particle size and the particle size distribution are measured by using a laser diffraction particle size distribution analyzer. Specifically, about 200 ml of ethanol is poured into a measurement cell of a laser diffraction particle size distribution analyzer ("LA-700," manufactured by HORIBA Ltd.), and about a 0.5 to 5 mg sample is suspended in ethanol. Next, while subjecting the sample to irradiation with an ultrasonic wave, the mixture is agitated for one minute, to thereby sufficiently disperse the sample. Thereafter, an He—Ne laser beam (632.8 nm) is irradiated, and the particle size distribution is measured from the diffraction/scattering patterns. The analysis is made based on the combined theories of Fraunhofer diffraction theory and Mie scattering theory. The particle size distribution of the suspended particles in the liquid is measured in the size range of from 0.04 to 262 $\mu$m. An average particle size is a median of the particle size distribution.

The average particle size in the above-given ranges can be obtained by adjusting powdering methods and the powdering conditions.

Examples of the crystalline alkali metal silicates usable in the present invention include alkali metal silicates having an $SiO_2/M_2O$ ratio (wherein M stands for an alkali metal) of preferably from 0.9 to 2.6, more preferably from 1.5 to 2.2. When the $SiO_2/M_2O$ ratio of the alkali metal silicates is less than 0.9, the anti-solubility in water becomes insufficient, which thereby makes it likely to cause deterioration by caking, and when the $SiO_2/M_2O$ ratio exceeds 2.6, both the alkalizing ability and ion exchange capacity are lowered, which thereby makes it likely to cause deterioration in the washing performance.

Among the crystalline alkali metal silicates usable in the present invention, preferred examples include those exemplified as having the following compositions (I) and (II).

$$1)\ xM_2O \cdot ySiO_2 \cdot zMe_mO_n \cdot wH_2O, \quad (I)$$

wherein M stands for an element in Group Ia of the Periodic Table; Me stands for one or more members selected from the group consisting of elements in Group IIa, IIb, IIIa, IVa, and VIII of the Periodic Table; y/x is from 0.9 to 2.6; z/x is from 0.01 to 1.0; n/m is from 0.5 to 2.0; and w is from 0 to 20; and $$2)\ M_2O \cdot x'SiO_2 \cdot y'H_2O, \quad (II)$$

wherein M stands for an alkali metal; x' is from 1.5 to 2.6; and y' is from 0 to 20.

First, the crystalline alkali metal silicates having the composition 1) above will be described in detail below.

In the general formula (I), M is selected from an element in Group Ia of the Periodic Table, wherein the Group Ia elements may be exemplified by Na, K, etc. The Group Ia elements may be used alone, or in admixture of two or more members. For instance, such compounds as $Na_2O$ and $K_2O$ may be mixed to constitute an $M_2O$ component.

Me stands for one or more members selected from the group consisting of elements in Group IIa, IIb, IIIa, IVa, and VIII of the Periodic Table, and examples thereof include Mg, Ca, Zn, Y, Ti, Zr, and Fe, which are not particularly limited to the above examples. Here, a preference is given to Mg and Ca from the viewpoint of resource stock and safety. In addition, these elements may be used alone, or in admixture of two or more members. For instance, such compounds as Mgo and CaO may be mixed to constitute an $Me_mO_n$ component.

In addition, the crystalline alkali metal silicates in the present invention may be in the form of hydrates, wherein the amount of hydration (w) is in the range of from 0 to 20 moles of $H_2O$.

In addition, in the general formula (I), y/x is from 0.9 to 2.6, preferably from 1.5 to 2.2. When y/x is less than 0.9, the anti-solubility in water of the crystalline alkali metal silicate is insufficient, so that the obtained crystalline alkali metal silicate has drastically poor caking ability, solubility, and other powder properties of the detergent composition. When y/x exceeds 2.6, the alkalizing ability is lowered, thereby making it insufficient to be used for an alkalizing agent, and its ion exchange capacity is lowered, thereby making it insufficient to be used for an ion exchange material. With respect to z/x, it is from 0.01 to 1.0, preferably from 0.02 to 0.9. When z/x is less than 0.01, the anti-solubility in water of the resulting crystalline alkali metal silicate is insufficient, and when z/x is preferably exceeds 1.0, the ion exchange capacity of the resulting crystalline alkali metal silicate is insufficient, thereby making it insufficient to be used for an ion exchange material. With respect to x, y and z, there are no particular limitations, as long as y/x and z/x have the above relationships. When $xM_2O$, for example, is $x'Na_2O \cdot x''K_2O$ as described above, x equals to x'+x". The same can be said for z when $zMe_mO_n$ comprises two or more components. Further, "n/m is from 0.5 to 2.0" indicates the number of oxygen ions coordinated to the above elements, which actually takes values selected from 0.5, 1.0, 1.5, and 2.0.

The crystalline alkali metal silicate in the present invention comprises three components, $M_2O$, $SiO_2$, and $Me_mO_n$, as indicated by the general formula (I) above. Materials which can be converted to each of these components, therefore, are indispensable for starting materials for producing the crystalline alkali metal silicate in the present invention. In the present invention, known compounds can be suitably used for starting materials without particular limitations. Examples of the $M_2O$ component and the $Me_mO_n$ component include simple or complex oxides, hydroxides and salts of respective elements; and minerals containing respective elements. Specifically, examples of the starting materials for the $M_2O$ component include, for instance, NaOH, KOH, $Na_2CO_3$, $K_2CO_3$, $Na_2SO_4$, and the like. Examples of the starting materials for the $Me_mO_n$ component include, for instance, $CaCO_3$, $MgCO_3$, $Ca(OH)_2$, $Mg(OH)_2$, MgO, $ZrO_2$, dolomite, and the like. Examples of the starting materials for the $SiO_2$ component include, for instance, silica sand, kaolin, talc, fused silica, sodium silicate, and the like.

In the present invention, a method of preparing the crystalline alkali metal silicate may be exemplified by blending the above starting material components to provide a desired composition in x, y, and z for the crystalline alkali metal silicate, and baking the resulting mixture at a temperature in the range of usually from 300° to 1500° C., preferably from 500° to 1000° C., more preferably from 600° to 900° C., to form crystals. In this case, when the heating temperature is less than 300° C., the crystallization is insufficient, thereby making the anti-solubility in water of the resulting crystalline alkali metal silicate poor, and when the heating temperature exceeds 1500° C., coarse grains are likely to be formed, thereby decreasing the ion exchange capacity. The heating time is usually 0.1 to 24 hours. Such baking can usually be carried out in a heating furnace such as an electric furnace or a gas furnace.

Next, the crystalline alkali metal silicates having the composition 2) above are described in detail below.

These crystalline alkali metal silicates are represented by the general formula (II):

$$M_2O \cdot x'SiO_2 \cdot y'H_2O, \quad \text{(II)}$$

wherein M stands for an alkali metal; x' is from 1.5 to 2.6; and y' is from 0 to 20.

Among them, a preference is given to the crystalline alkali metal silicates having x' and y' in the general formula (II) such that each satisfies $1.7 \leqq x' \leqq 2.2$ and y'=0, and those having a cationic exchange capacity of 100 $CaCO_3$ mg/g or more, preferably from 200 to 400 $CaCO_3$ mg/g, can be used. The above crystalline alkali metal silicates are one of the substances having ion capturing capacity in the present invention.

The above crystalline alkali metal silicates may be produced by the method disclosed in Japanese Patent Laid-Open No. Sho 60-227895. However, the crystalline silicates can be generally produced by baking glassy amorphous sodium silicates at a temperature of from 200° to 1000° C. Details of the production method is disclosed in "Phys. Chem. Glasses, 7, pp.127–138 (1966), Z. Kristallogr., 129, pp.396–404(1969)." Also, the crystalline alkali metal silicates are commercially available in powdery or granular forms under a trade name "Na-SKS-6" ($\delta$-$Na_2Si_2O_5$) (manufactured by Hoechst).

The detergent granules of the present invention contain the nonionic surfactant and the crystalline alkali metal silicate as essential components, and there may be included other components, such as surfactants other than the nonionic surfactants, amorphous alkali metal silicates, metal ion capturing agents other than the alkali metal silicates, alkalizing agents, and builders, such as non-dissociating polymers and salts of organic acids each of which is exemplified below, color fading preventives, recontamination preventives, caking preventives, antioxidants, defoaming agents, bleaching agents, bleaching activators, fluorescent dyes, blueing agents and perfume.

Here, in the case where the amount of the nonionic surfactant accounts for 50% by weight or more of the entire surfactants in the detergent granules, the effects of the present invention can be even more remarkably exhibited.

The detergent granules of the present invention comprise each of the above components, and the production methods therefor are not particularly limited and any of conventionally known methods may be used. Examples thereof include granulation methods disclosed in Japanese Patent Laid-Open Nos. Hei 5-209200 and Hei 3-160100 and Japanese Patent Unexamined Publication No. Hei 6-502445. Incidentally, the crystalline alkali metal silicates are preferably dry-blended upon granulation of the detergent granules of the present invention. Also, when spray-dried granules are used, the nonionic surfactant may be blended in a slurry composition. Alternatively, the nonionic surfactant may be directly dry-blended with the crystalline alkali metal silicates to thereby coat the powder surfaces of the crystalline alkali metal silicate with a continuous phase of the nonionic surfactant, in which the effects of the present invention are particularly remarkable.

The resulting detergent granules of the present invention obtainable by the above production method preferably have an average particle size of from 200 to 800 $\mu$m, particularly from 300 to 600 $\mu$m. In addition, the detergent granules have a bulk density measured according to JIS K 3362 of preferably 600 g/L or more, more preferably from 700 to 1000 g/L.

In the granular detergent composition characterized in that the granular detergent composition comprises the detergent granules of the present invention, the production methods therefor, other ingredients, and the compositions are equivalent to conventionally known granular detergent compositions without being particularly limited, except that the content of the iron components, the content of the nonionic surfactant, and the content of the crystalline alkali metal silicates are in the ranges specified above.

For instance, granular detergents may be prepared by dry-blending the above detergent granules used as base materials with various granules which individually comprise at least one of enzymes, bleaching agents, bleaching activators, and/or defoaming agents as main components thereof. Alternatively, the granular detergent may be prepared by after-blending conventional detergents comprising anionic surfactants as base materials with the above various granules acting as builder granules. In either method, it is, needless to say, very important to obtain a good appearance of the overall detergent.

Each of other ingredients which are contained in the overall detergent composition containing the detergent granules will be described in detail below.

Surfactants Other Than Nonionic Surfactants

The surfactants other than the nonionic surfactants usable in the present invention are not particularly limited, and any ones usually used for detergents are used aside from the nonionic surfactants mentioned above. Specifically, the surfactants may be one or more members selected from the group consisting of anionic surfactants, cationic surfactants, and amphoteric surfactants, each being exemplified below.

Examples of the anionic surfactants include alkylbenzenesulfonates, alkyl or alkenyl ether sulfates, alkyl or alkenyl sulfates, α-olefinsulfonates, α-sulfofatty acid salts, α-sulfofatty acid ester salts, alkyl or alkenyl ether carboxylates, amino acid-type surfactants, N-acyl amino acid-type surfactants, and the like, with a preference given to alkylbenzenesulfonates, alkyl or alkenyl ether sulfates, alkyl or alkenyl sulfates, and the like.

Examples of the cationic surfactants include quaternary ammonium salts, such as alkyl trimethylamine salts, and the like. Examples of the amphoteric surfactants include carboxy-type and sulfobetaine-type amphoteric surfactants, and the like.

The surfactant content is preferably from 1 to 45% by weight of the entire granular detergent composition.

Metal Ion Capturinq Agents Other Than Crystalline Alkali Metal Silicates

The metal ion capturing agents other than the crystalline alkali metal silicates in the present invention preferably have a calcium ion capturing capacity of 200 $CaCO_3$ mg/g or more.

In particular, a preference is given to the metal ion capturing agents containing a carboxylate polymer in an amount of 10% by weight or more. Examples of the above carboxylate polymer include polymers or copolymers, each having repeating units represented by the general formula (III):

(III)

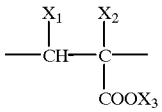

wherein $X_1$ stands for methyl, H, or $COOX_3$; $X_2$ stands for methyl, H, or OH; $X_3$ stands for H, an alkali metal, an alkaline earth metal, $NH_4$. or ethanolamine.

In the general formula (III), examples of the alkali metals include Na, K, Li, and the like, and examples of the alkaline earth metals include Ca, Mg, and the like.

Examples of the polymers or copolymers usable in the present invention include, for instance, those obtainable by polymerization reactions of acrylic acid, (anhydrous) maleic acid, methacrylic acid, α-hydroxyacrylic acid, crotonic acid, isocrotonic acid, and salts thereof; copolymerization reactions of each of the monomers; or copolymerization reactions of the above monomers with other polymerizable monomers. Here, examples of the copolymerizable monomers used in copolymerization reaction include aconitic acid, itaconic acid, citraconic acid, fumaric acid, vinyl phosphonic acid, sulfonated maleic acid, diisobutylene, styrene, methyl vinyl ether, ethylene, propylene, isobutylene, pentene, butadiene, isoprene, vinyl acetate (vinyl alcohols in cases where hydrolysis takes place after copolymerization), and acrylic acid ester, without particularly being limited thereto. Incidentally, the polymerization reactions are not particularly limited, and any of the conventionally known methods may be employed.

Also, polyacetal carboxylic acid polymers such as polyglyoxylic acids disclosed in Japanese Patent Laid-Open No. Sho 54-52196 are also usable for the polymers in the present invention.

In the present invention, the above polymers and copolymers usually have a weight-average molecular weight of from 800 to 1,000,000, preferably from 5,000 to 200,000.

Also, in the case of copolymers, although the copolymerization ratio between the repeating units of the general formula (III) and other copolymerizable monomers is not particularly limited, a preference is given to a copolymerization ratio of the repeating units of general formula (III)/other copolymerizable monomer=1/100 to 90/10.

In the present invention, the above polymer or copolymer is contained in the entire composition in an amount of preferably from 1 to 50% by weight, more preferably from 2 to 30% by weight, particularly from 5 to 15% by weight.

In addition, an aluminosilicate having an ion exchange capacity of not less than 200 $CaCO_3$ mg/g and having the following formula (IV) may be also used:

$$x''(M_2O)\cdot Al_2O_3\cdot y''(SiO_2)\cdot w''(H_2O), \quad \text{(IV)}$$

wherein M stands for an alkali metal, such as sodium and potassium; x", y", and w" each stands for a molar number of each component, each of which generally satisfies $0.7 \leqq x'' \leqq 1.5$; $0.8 \leqq y'' \leqq 6$; and w" being from 0 to 20.

The aluminosilicates mentioned above may be crystalline or amorphous. Among the crystalline aluminosilicates, a particular preference is given to those having the following general formula:

$$Na_2O\cdot Al_2O_3\cdot ySiO_2\cdot wH_2O,$$

wherein y is a number of from 1.8 to 3.0; and w is a number of from 1 to 6.

As for the crystalline aluminosilicates (zeolites), synthetic zeolites having an average, primary particle size of from 0.1 to 10 μm, which are typically exemplified by A-type zeolite, X-type zeolite, and P-type zeolite, are suitably used. The zeolite may be used in the forms of powder, and/or a zeolite slurry, or dried particles comprising zeolite aggregates obtained by drying the slurry. The zeolites of the above forms may also be used in combination.

The above crystalline aluminosilicates are obtainable by conventional methods. For instance, methods disclosed in Japanese Patent Laid-Open Nos. Sho 50-12381 and Sho 51-12805 may be employed.

On the other hand, the amorphous aluminosilicates represented by the same general formula as the above crystalline aluminosilicate can be also prepared by conventional methods. For instance, the amorphous aluminosilicates are prepared by adding an aqueous solution of a low-alkali alkali metal aluminate having a molar ratio of $M_2O$ to $Al_2O_3$ (M standing for an alkali metal) of $M_2O/Al_2O_3$=1.0 to 2.0 and a molar ratio of $H_2O$ to $M_2O$ of $H_2O/M_2O$=6.0 to 500 to an aqueous solution of an alkali metal silicate having a molar ratio of $SiO_2$ to $M_2O$ of $SiO_2/M_2O$=1.0 to 4.0 and a molar ratio of $H_2O$ to $M_2O$ of $H_2O/M_2O$=12 to 200 under vigorous stirring at usually 15° to 60° C., preferably 30° to 50° C. Here, in this addition method, the aqueous solution of an alkali metal silicate may be added to the aqueous solution of a low-alkali alkali metal aluminate.

Subsequently, the intended product can be advantageously obtained by heat-treating a white slurry of precipitates thus formed at 70° to 100° C., preferably 90° to 100° C., for usually not less than 10 minutes and not more than 10 hours, preferably not more than 5 hours, followed by filtration, washing and drying.

By this method, an oil-absorbing carrier of the amorphous aluminosilicate having an ion exchange capacity of not less than 100 $CaCO_3$ mg/g and an oil-absorbing capacity of not less than 80 ml/100 g can be easily obtained (see Japanese Patent Laid-Open Nos. Sho 62-191417 and Sho 62-191419).

Examples of other metal ion capturing agents include aminotri(methylenephosphonic acid), 1-hydroxyethylidene-1,1-diphosphonic acid, ethylenediaminetetra (methylenephosphonic acid), diethylenetriaminepenta (methylenephosphonic acid), and salts thereof; salts of phosphonocarboxylic acids, such as salts of 2-phosphonobutane-1,2-dicarboxylic acid; amino acid salts, such as aspartates and glutamates; aminopolyacetates, such as nitrilotriacetates and ethylenediaminetetraacetates.

Examples of other ingredients used in the present invention as alkalizing agents besides crystalline and amorphous alkali metal silicates include various compounds including alkali metal salts such as alkali metal carbonates and alkali metal sulfites, and organic amines, such as alkanolamines.

In addition, color-fading preventives, and recontamination preventives generally used for detergent compositions, including non-dissociating polymers such as polyethylene glycols, polyvinyl alcohols, and polyvinyl pyrrolidones; organic acid salt builders, such as diglycolates and hydroxycarboxylates; and carboxymethyl cellulose may be optionally used.

In addition, the following ingredients may be also included. Specifically, there may be included enzymes, such as protease, lipase, cellulose, and amylase; caking preventives, such as lower alkylbenzenesulfonates whose alkyl moieties have about 1 to 4 carbon atoms, sulfosuccinates, talc, and calcium silicates; antioxidants, such as tert-butylhydroxytoluene and distyrenated cresol; bleaching agents, such as sodium percarbonate; bleaching activators, such as tetraacetyl ethylenediamine; fluorescent dyes; blueing agents; perfume, and the like, without being particularly limited thereto, to give compositions according to their purposes.

The present invention will be explained hereinbelow by means of the following preparation examples, working examples and comparative examples, but the present invention is by no means limited to these examples, and the like.

Preparation Example 1

As for the crystalline alkali metal silicates, those having relatively low Fe contents were selected from several kinds of products with different lot numbers of powdery Na-SKS-6 (manufactured by Hoechst; average particle size: 120 μm; and Fe content: 90 ppm). Each of the crystalline alkali metal silicates was pulverized under the following conditions mentioned below, to give pulverized products "A" to "C" of the crystalline alkali metal silicates.

Pulverized Product A of Crystalline Alkali Metal Silicate

Using a vertical roller mill "IS-150 Type" (manufactured by Ishikawajima Harima Jukogyo Kabushiki Kaisha), the powdery Na-SKS-6 was pulverized under the following conditions to give a pulverized product "A" of crystalline alkali metal silicate:

Rotational speed of table: 30 rpm,

Cylinder hydraulic pressure for adjusting pressure roller: 20 kg/cm$^2$,

Rotational speed of separator: 150 rpm,

Gas volume: 8 m$^3$/minute, and

Treatment rate: 30 kg/hour.

The pulverized product "A" of crystalline alkali metal silicate had an average particle size of 25 μm, and an Fe content in the pulverized product of 104 ppm.

Pulverized Product B of Crystalline Alkali Metal Silicate

Using an ACM pulverizer "ACM-10 Type" (manufactured by Hosokawa Micron Corporation), wherein powder-contacting parts were all made of ceramics (PSZ), the powdery Na-SKS-6 was pulverized under the following conditions to give a pulverized product "B" of crystalline alkali metal silicate:

Rotational speed of rotor: 5400 rpm,

Rotational speed of separator: 1500 rpm,

Gas volume: 13 m$^3$/minute, and

Treatment rate: 200 kg/hour.

The pulverized product "B" of crystalline alkali metal silicate had an average particle size of 29 μm, and an Fe content in the pulverized product of 90 ppm.

Pulverized Product C of Crystalline Alkali Metal Silicate

The pulverization process was carried out under the same conditions as those of Pulverized Product "B" described above, except that the powder-contacting parts of the ACM pulverizer was made of SUS Steel "SUS 304," to give a pulverized product "C" of crystalline alkali metal silicate. The pulverized product "C" of crystalline alkali metal silicate had an average particle size of 28 μm, and an Fe content in the pulverized product of 160 ppm.

Preparation Example 2 (Amorphous Aluminosilicate)

Sodium carbonate was dissolved in ion-exchanged water, to prepare an aqueous solution with 6% by weight concentration. 132 g of the above aqueous solution and 38.28 g of a sodium aluminate aqueous solution (conc. 50% by weight) were placed in a 1000-ml capacity reaction vessel equipped with baffles. 201.4 grams of a solution of No. 3 Water Glass diluted with water twice were added dropwise to the above mixed solution under vigorous agitation at a temperature of 40° C. over a period of 20 minutes. Here, the reaction speed was optimized by controlling the pH of the reaction system (pH: 10.5) by blowing a $CO_2$ gas thereinto. Subsequently, the reaction system was heated to a temperature 50° C. of and stirred at the same temperature for 30 minutes. Thereafter, an excess alkali was neutralized (pH: 9.0) by blowing a $CO_2$ gas into the reaction system. The obtained neutralized slurry was filtered under a reduced pressure using a filter paper (No. 5C, manufactured by Toyo Roshi Kaisha, Ltd.). The filtered cake was rinsed with water in an amount of 1000-folds, and the rinsed cake was filtered and dried (under the conditions of 105° C., 300 Torr, and 10 hours). Further, the dried cake was disintegrated into particles, to give an amorphous aluminosilicate powder in the present invention. Incidentally, the sodium aluminate aqueous solution was prepared by the steps of adding and mixing 243 g of $Al(OH)_3$ and 298.7 g of a 48% by weight NaOH aqueous solution in a 1000 cc-capacity four-necked flask, heating the mixture to a temperature of 110° C. with stirring, and dissolving the components over a period of 30 minutes.

As shown by the results of atomic absorption spectrophotometry and plasma emission spectrochemical analysis, the resulting amorphous aluminosilicate had the following composition: $Al_2O_3$=29.6% by weight; $SiO_2$=52.4% by weight; and $Na_2O$=18.0% by weight ($1.0\ Na_2O \cdot Al_2O_3 \cdot 3.10\ SiO_2$). In addition, the amorphous aluminosilicate had the following properties: The calcium ion capturing capacity was 185 $CaCO_3$ mg/g, and the oil-absorbing capacity was 285 ml/100 g. The percentage of the microporous capacity having a microporous diameter of less than 0.1 $\mu$m was 9.4%, and the percentage of the microporous capacity having a microporous diameter of not less than 0.1 $\mu$m and not more than 2.0 $\mu$m was 76.3%. The water content was 11.2% by weight.

Examples 1 and 2

2.5 kg of the resulting pulverized product "A" and 0.75 kg of an amorphous aluminosilicate were placed in a Lödige mixer. Thereafter, while stirring the above components at room temperature, 1.25 kg of a polyoxyethylene alkyl ether ($C_{12}$, EO=6) was gradually added dropwise to carry out agitation-tumbling granulation. After the granulation process was completed, the resulting granules were subjected to a surface-improvement treatment by adding and mixing 0.5 kg of 4A zeolite powder, to give detergent granules.

The same procedures and processes as above were carried out except for adding the resulting pulverized product "B" of the crystalline alkali metal silicate in place of the above pulverized product "A," to give detergent granules.

Comparative Example 1

The same procedures and processes as above were carried out except for adding the resulting pulverized product "C" of the crystalline alkali metal silicate in place of the above pulverized product "A," to give detergent granules.

The results for the Fe contents, the degree of whiteness, and the evaluation of hue of the detergent granules obtained in each of the above Examples and Comparative Examples are shown in Table 1.

Here, the iron content was measured by the steps of completely ashing 0.5 g of the detergent granules, dissolving the obtained ash in 2 ml of 6N-HCl, diluting the obtained solution, and then analyzed by ICP (plasma emission spectrochemical analysis). In addition, an L value measured by a color-and-color difference meter "1001DP" (manufactured by Nippon Denshoku Kogyo Kabushiki Kaisha) was used as index for the degree of whiteness.

TABLE 1

| Composition of Detergent Granules (% by weight) | | Examples 1 | Examples 2 | Comp. Example 1 |
|---|---|---|---|---|
| Crystalline Alkali Metal Silicate | A | 50 | | |
| | B | | 50 | |
| | C | | | 50 |
| Polyoxyethylene Alkyl Ether ($C_{12}EO_8$) | | 25 | 25 | 25 |
| Amorphous Aluminosilicate | | 15 | 15 | 15 |
| 4 A Zeolite Powder | | 10 | 10 | 10 |
| Fe Content of Detergent | | 57 | 50 | 85 |

TABLE 1-continued

| Composition of Detergent Granules (% by weight) | Examples 1 | Examples 2 | Comp. Example 1 |
|---|---|---|---|
| Granules (ppm) | | | |
| Degree of Whiteness of Detergent Granules (L value) | 90 | 93 | 76 |
| Evaluation of Gross Examination of Hue of Detergent Granules | ○*2 | ◎*1 | x*3 |

*1Completely white.
*2Almost white.
*3Gray.

INDUSTRIAL APPLICABILITY

The detergent granules have excellent sebum dirt detergency performance and comprise a crystalline alkali metal silicate and a nonionic surfactant, wherein the detergent granules of the present invention have high commercial values owing to their improved hue and excellent degree of whiteness. Therefore, the granular detergent composition containing these detergent granules have excellent degree of whiteness.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Detergent granules comprising:

10% by weight or more of a nonionic surfactant and

1% by weight or more of a crystalline alkali metal silicate having an average particle size of from 1 to 30 $\mu$m, and being represented by the following formula (II):

$$M_2O \cdot x'SiO_2 \cdot y'H_2O, \quad \text{(II)}$$

wherein M represents an alkali metal; x' is from 1.5 to 2.6; and y' is from 0 to 20;

wherein the detergent granules are characterized in that surfaces comprising said crystalline alkali metal silicates are coated with a continuous phase of the nonionic surfactant, and wherein the weight ratio of said nonionic surfactant to said crystalline alkali metal silicate is from 20/1 to 1/20, and wherein the iron content calculated as Fe in said crystalline alkali metal silicate is 140 ppm or less; and wherein said crystalline alkali metal silicate is powdered using a method selected from the group consisting of:

(a) methods using a device which provides for the mutual contact of masses of crystalline alkali metal silicates, and (b) methods using a device wherein the parts of the device used for powdering are made of materials other than iron or are coated with materials other than iron.

2. The detergent granules according to claim 1, characterized in that said nonionic surfactant is a polyoxyethylene alkyl ether.

3. The detergent granules according to claim 1, characterized in that said crystalline alkali metal silicate has an $SiO_2/M_2O$ ratio of from 0.9 to 2.6, wherein M stands for an alkali metal.

4. The detergent granules according to claim 1, characterized in that the degree of whiteness as determined by the L value is 90% or more.

5. A granular detergent composition characterized in that the granular detergent composition comprises the detergent granules according to claim 1.

6. The detergent granules according to claim 1, wherein said materials other than iron are selected from the group consisting of cemented carbides and ceramics.

7. The detergent granules according to claim 1, wherein the nonionic surfactant is present at 15% by weight or more.

8. The detergent granules according to claim 1, wherein the crystalline alkali metal silicate is present at 3% by weight or more.

9. The detergent granules according to claim 1, wherein said weight ratio is from 20/1 to 1/5.

10.The detergent granules according to claim 3, wherein the $SiO_2/M_2O$ ratio is from 1.5 to 2.2.

* * * * *

UNITED STATES PATENT AND TRADEMARK OFFICE

CERTIFICATE OF CORRECTION

PATENT NO. : 6,335,313 B1
DATED : January 1, 2002
INVENTOR(S) : Katsuhiko Kasai et al.

It is certified that error appears in the above-identified patent and that said Letters Patent is hereby corrected as shown below:

Title page,
Item [54], please change the title from "DETERGENT GRAINS AND GRANULAR DETERGENT COMPOSITION" to -- DETERGENT GRANULES BASED ON NONIONIC SURFACTANT AND CRYSTALLINE ALKALI METAL SILICATE, AND COMPOSITIONS COMPRISING SAME --.

Signed and Sealed this

Third Day of September, 2002

*Attest:*

*Attesting Officer*

JAMES E. ROGAN
*Director of the United States Patent and Trademark Office*